United States Patent [19]

Brown et al.

[11] 4,300,810

[45] Nov. 17, 1981

[54] ZERO INSERTION FORCE CONNECTOR

[75] Inventors: James B. Brown, Naperville; Randall W. France, Oswego, both of Ill.

[73] Assignee: Bell Telephone Laboratories, Incorporated, Murray Hill, N.J.

[21] Appl. No.: 137,593

[22] Filed: Apr. 7, 1980

[51] Int. Cl.[3] ..... H01R 13/62

[52] U.S. Cl. ..... 339/74 R

[58] Field of Search ..... 339/74 R, 75 M, 75 MP

[56] References Cited

U.S. PATENT DOCUMENTS

| | | | |
|---|---|---|---|
| 3,487,352 | 12/1969 | Putyato et al. | 339/66 |
| 3,670,288 | 6/1972 | Evans | 339/74 R |
| 3,793,609 | 2/1974 | McIver | 339/74 R |
| 3,963,317 | 6/1976 | Eigenbrode et al. | 339/74 R |
| 3,982,807 | 9/1976 | Anhalt et al. | 339/75 MP |
| 3,992,653 | 11/1976 | Richardson et al. | 317/100 |
| 4,047,782 | 9/1977 | Yeager | 339/75 MP |
| 4,068,170 | 1/1978 | Chayka et al. | 324/72.5 |
| 4,072,379 | 2/1978 | Towne et al. | 339/17 LM |
| 4,077,688 | 3/1978 | Cobaugh et al. | 339/74 R |
| 4,119,357 | 10/1978 | Bonhomme | 339/75 MP |
| 4,148,537 | 4/1979 | Sochor | 339/74 R |
| 4,153,948 | 5/1979 | Dimyan et al. | 365/28 |
| 4,159,154 | 6/1979 | Arnold | 339/74 R |
| 4,211,458 | 7/1980 | Kent | 339/74 R |

*Primary Examiner*—Joseph H. McGlynn

*Attorney, Agent, or Firm*—William H. Kamstra; Peter Visserman

[57] ABSTRACT

A zero insertion force connector for making contact with the electrical terminals of four printed wiring boards. Two pairs of parallel plates (16, 17; 18, 19), each pair mounted for lateral movement and having a plurality of terminals (29) for making contact with the corresponding electrical terminals of two printed wiring boards when inserted therebetween, are each separated and closed by the rotation of a shaft (37) having two cam plates (39, 40) mounted near the opposite ends thereof. The two cam plates (39, 40) mounted next to the opposite ends of the two pairs of plates (16, 17; 18, 19), respectively, converts the rotational movement of the shaft (37) to the lateral movement of the two pairs of plates (16, 17; 18, 19) thereby separating and closing each pair of plates (16, 17; 18, 19).

11 Claims, 3 Drawing Figures

ZERO INSERTION FORCE CONNECTOR

BACKGROUND OF THE INVENTION

This invention relates generally to electrical connectors and, more particularly, to connectors for making electrical connections with the terminals of printed wiring boards and the like.

Typically, a connector for a printed wiring board comprises an assembly with a slot to accept an edge of the board and with resilient contact members in the slot to connect to the electrical terminals of the board. Substantial force may frequently be required to insert a printed wiring board into a connector slot having a large number of resilient contact members therein due to the resilient engaging force of the contacts with the edge of the board. A common result of such direct insertion of boards into connectors with resilient contact members is to damage the electrical terminals of the board as well as to wear the resilient contact members. It is a common practice, therefore, to provide a connector in which the resilient contact members are removed from the insertion path of the board whereby no resistance is encountered during insertion of the board into the connector.

One example of a zero insertion force connector is shown in U.S. Pat. No. 3,793,609 issued Feb. 19, 1974, to W. McIver. This patent discloses an elongated cam member insertable between a pair of rows of resilient contact members to retract temporarily the resilient contact members for insertion therebetween of a printed wiring board. The elongated cam member is rotated to engage and to retract the resilient contact members to allow insertion of the printed wiring board. After insertion of the board, the cam member is again rotated to disengage the resilient contact members thereby connecting the contact members to the electrical terminals of the board.

Other examples of zero insertion force connectors are shown in U.S. Pat. No. 4,077,688 issued Mar. 7, 1978, to R. F. Cobaugh, et al.; U.S. Pat. No. 4,148,537 issued Apr. 10, 1979, to J. R. Sochor; and U.S. Pat. No. 4,159,154 issued June 26, 1979, to B. K. Arnold. The apparatus of these patents are characterized by the provision of facilities for retracting a pair of rows of opposing resilient contact members for insertion therebetween of a printed wiring board. The retractiion is accomplished by two retractor elements each engaging a nonopposing portion of a row of the resilient contact members and a cam element. Upon actuation of the cam element, the cam and retractor elements slide against one another thereby spreading the retractor elements apart which in turn retract the opposing resilient contact members. Upon insertion of a board therebetween and actuation of the cam in a reverse direction, the resilient contact members engage the electrical terminals of the board.

Among the disadvantages of these prior art zero insertion force connectors is the fact that, they receive only printed wiring boards having fixed electrical terminals, they depend upon the resiliency of the contact members to make electrical connections with the electrical terminals of the printed wiring board, and they are constructed with materials having limited durability under repeated usage.

It is an objective of this invention to provide a durable connector for making contact with the electrical terminals of a plurality of printed wiring boards with zero force. A second objective is to provide a connector to receive printed wiring boards having either fixed or resilient electrical terminals. A third objective is to provide a connector having positive means for making contact with the electrical terminals of a printed wiring board.

SUMMARY OF THE INVENTION

The foregoing and other objectives of this invention are realized in one specific embodiment thereof comprising a zero insertion force connector having two pairs of parallel plates between which four printed wiring boards are inserted. The opposing faces of the parallel plates have contact members for making contact with corresponding resilient electrical terminals of the printed wiring boards. After the printed wiring boards are inserted, a shaft running between and parallel to the parallel plates is rotated to turn a pair of cam plates mounted on the shaft near the ends of the parallel plates. Pins mounted at the ends of the parallel plates are moved by appropriate slots in the cam plates as the latter are rotated to close the parallel plates together thereby resulting in the contact members connecting to the resilient electrical terminals of the inserted printed wiring boards.

BRIEF DESCRIPTION OF THE DRAWING

The foregoing and other objectives and features of this invention will be better understood from a consideration of the detailed description of the organization and operation of one illustrative embodiment which follows when taken in conjunction with the accompanying drawing in which.

DETAILED DESCRIPTION

Figure 1:
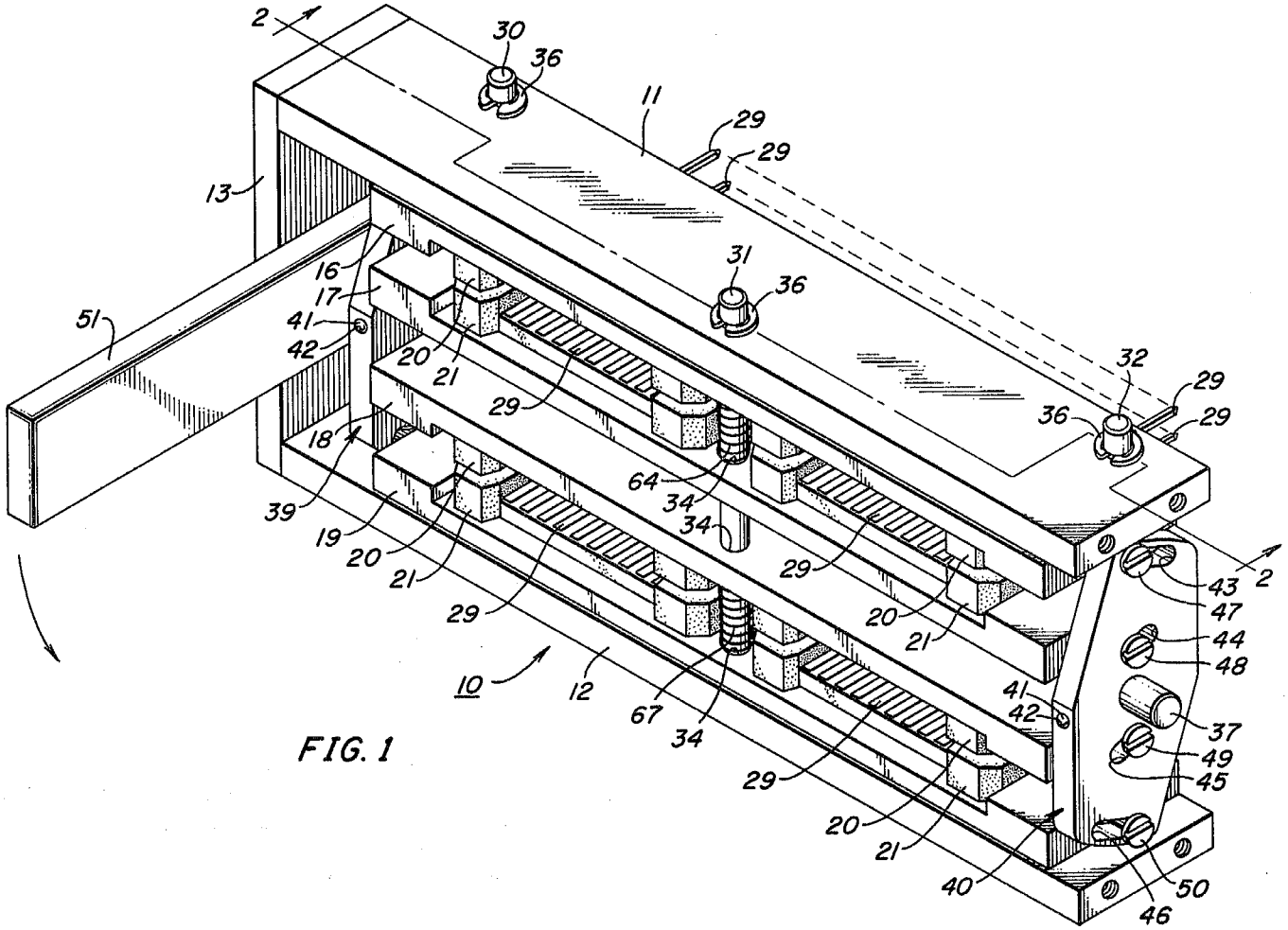
FIG. 1 is a perspective view of one specific zero insertion force connector according to the principles of this invention, the connector being shown with an end plate removed to expose the structural details.
Figure 2:
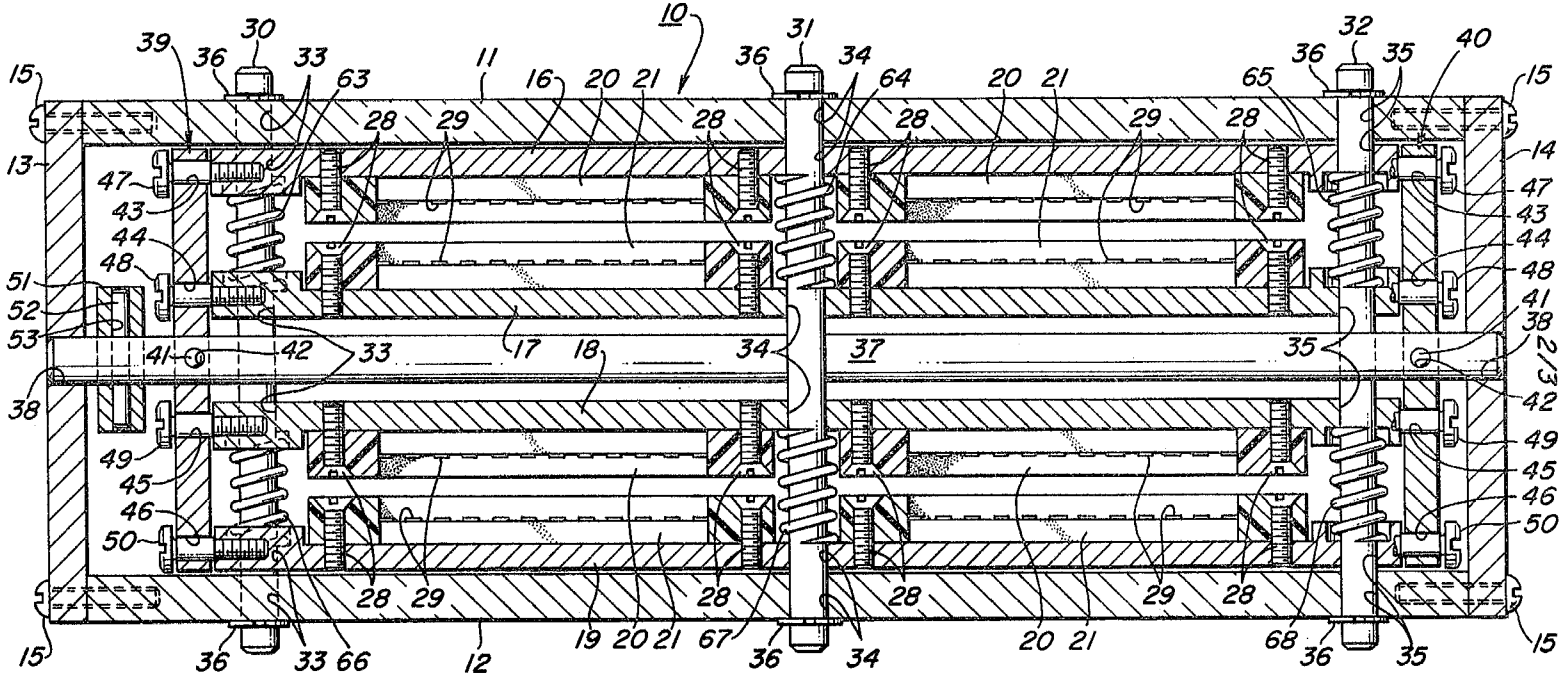
FIG. 2 is a cross-section side view of the zero insertion force connector of FIG. 1 taken along the line 2—2.

An illustrative zero insertion force connector assembly according to this invention is shown in FIG. 1 and 2. The operative structure of the invention is contained in a substantially rectangular frame 10 having parallel side walls 11 and 12 and parallel end walls 13 and 14, end wall 14 not being shown in FIG. 1. Walls 11 through 14 are fastened together by any suitable means known in the art, for example, bolts 15, as partially shown in FIG. 2.

One portion of the operative structure includes a first pair of opposing, parallel, rectangular mounting plates 16 and 17 and a second pair of plates 18 and 19 identical to the first pair positioned laterally between and parallel to side walls 11 and 12.

Figure 3:
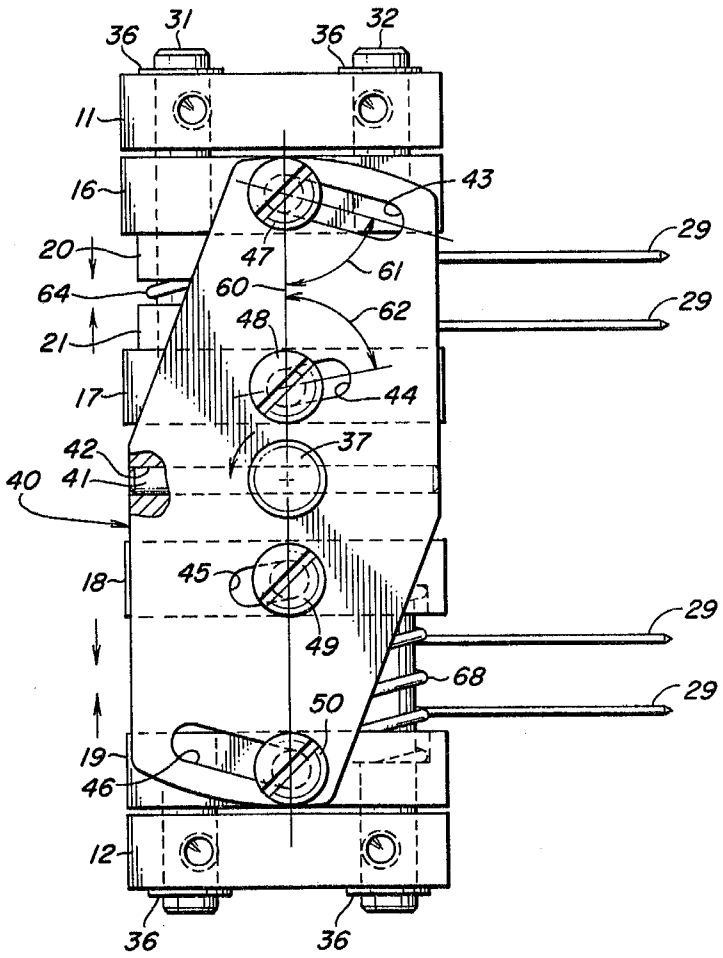
FIG. 3 is an enlarged plan end view of the zero insertion force connector of FIG. 1.

Each pair of plates 16–17 and 18–19 has two pairs of opposing, rectangular connector halves 20 and 21 tandemly mounted on the opposing faces thereof using any suitable means known in the art, for example, bolts 28. Each pair of connector halves 20 and 21 is formed of any suitable nonconductive materials, such as 40 percent glassfilled polyphenylene sulfide, for example, and is adapted to clamp a printed wiring board, not shown, when inserted therebetween. Electrical terminals 29 extending from the rear of frame 10, as shown in FIG. 1 and 3, correspond to the resilient electrical terminals of the printed wiring board and are mounted using any suitable means known in the art on the opposing faces of each pair of connector halves 20 and 21. Plates 16 through 19 are slidably mounted for lateral movement in frame 10 by three guide pins 30 through 32 inserted respectively in three aligned holes 33 through 35 formed in plates 16 through 19 and side walls 11 and 12. Guide pins 30 through 32 are maintained in place using any suitable means, for example, a retainer ring 36 at each end thereof. Holes 33 through 35 are located so that guide pins 30 through 32 do not obstruct the insertion and withdrawl of printed wiring boards between the pairs of connector halves 20 and 21.

The other portion of the operative structure includes a shaft 37 positioned between and parallel to the first pair of plates 16 and 17 and the second pair of plates 18 and 19. The opposite ends of shaft 37 are rotatably fitted in a hole 38 formed in each of the end walls 13 and 14. Oblong cam plates 39 and 40 are fixedly mounted at the opposite ends of shaft 37 substantially perpendicular thereto between end walls 13 and 14 and the opposite ends of plates 16 through 19, respectively, by means of dowel pins 41 press-fitted into aperture 42 formed therein and in shaft 37. Cam plates 39 and 40 each has a first pair of slots 43 and 44 and a second pair of slots 45 and 46 formed therein. The slots are dimensioned to receive pin means, for example, a first pair of shoulder bolts 47 and 48 and a second pair of shoulder bolts 49 and 50, attaching respectively to the opposite ends of the first pair of plates 16 and 17 and the second pair of plates 18 and 19. As shown in FIG. 1 and 2, a handle 51 is fixedly mounted on shaft 37 between cam plate 39 and end wall 13 by any suitable means, for example, a dowel pin 52 press-fitted into aperture 53 formed therein and in shaft 37.

As shown in FIG. 3, the longitudinal axes of the first pair of shoulder bolts 47 and 48 and the second pair of shoulder bolts 49 and 50 and shaft 37 intersect a reference axis 60. The first pair of slots 43 and 44 lie with respect to reference axis 60 at opposing angles 61 and 62, respectively. Angles 61 and 62 will be further defined hereinafter in conjunction with a description of illustrative operations of the zero insertion force connector according to this invention. The second pair of slots 45 and 46 are positioned diametrically opposite the first pair of slots 43 and 44 also at predetermined opposing angles with reference axis 60. When viewed from the same end of shaft 37, slots 43 through 46 in cam plate 39 are positioned identically to slots 43 through 46 in cam plate 40. Although, as mentioned, the longitudinal axes of the first pair of slots 43 and 44 and the second pair of slots 45 and 46 and shaft 37 are shown as intersecting a common axis 60, it will be appreciated that other arrangements may provide for the positioning of the slots on other axes. It is also shown that the first pair of slots 43 and 44 and the second pair of slots 45 and 46 are positioned diametrically opposite each other; it will be appreciated that here also other positionings are possible. The parts of the connector may be formed of any suitable material known in the art, for example, steel or aluminum, unless previously specified.

A description of illustrative operations of the connector assembly according to this invention may now be addressed. The connector has an open and a closed position. Accordingly, two operational descriptions, one an illustrative operation from the open to the closed position and the other from the closed to the open position, of the connector will be considered.

As shown in FIG. 2, coil springs 63 through 65 having substantially equivalent compressive forces are fitted respectively about guide pins 30 through 32 between plates 16 and 17 and exert separating forces thereon. Coil springs 66 through 68 positioned likewise between plates 18 and 19 also exert separating forces thereon. In the open position, these separating forces may be opposed by counteracting forces exerted by cam plates 39 and 40 on the pin means attached to the opposite ends of the plates 16 through 19 and slidably inserted in slots 43 through 46. As shown in FIG. 3, cam plate 40 does exert counteracting forces on the first pair of shoulder bolts 47 and 48 and the second pair of shoulder bolts 49 and 50 thereby limiting the maximum separation of the first pair of plates 16 and 17 and the second pair of plates 18 and 19.

Assuming a printed wiring board, not shown, is inserted between each pair of connector halves 20 and 21, the description of an illustrative operation from the open to the closed position of the connector may now be addressed. To operate the connector from the open to the closed position, shaft 37 is rotated in a counterclockwise direction, as indicated in FIG. 3, by exerting a downward force on the unmounted end of handle 51, as viewed in FIG. 1. With the counterclockwise rotation of shaft 37, the angled side walls of slots 43–44 and 45–46 of cam plates 39 and 40 exert forces on each of the first pair of shoulder bolts 47 and 48 and the second pair of shoulder bolts 49 and 50 thereby causing the lateral movement of each pair of plates toward one another on guide pins 30 through 32 as indicated by the arrows in FIG. 3. Opposing angles 61 and 62 are selected to cause, by cam action, the desired lateral movement of each pair of plates 16–17 and 18–19 toward one another. As shown in FIG. 3, opposing angles 61 and 62 are unequal to cause each plate 16 through 19 to move an equal lateral distance. Outer slots 43 and 46 are longer than slots 44 and 45 due to the necessarily greater travel of their pin means as shaft 37 is rotated. The rotation of shaft 37 is continued counterclockwise until connector halves 20 and 21 make contact with and clamp the printed wiring boards assumed as being inserted therebetween. This constitutes the closed position.

In the closed position, terminals 29 are making electrial connections with the corresponding resilient electrical terminals of the printed wiring boards. Although not shown, handle 51 may be latched in the closed position by any suitable means known in the art to prevent coils 63 through 68 from separating the pairs of plates 16–17 and 18–19.

To remove with zero force the printed wiring boards from the connector, the operation in the foregoing is simply reversed.

What has been described is considered to be only one specific illustrative zero insertion force connector according to the invention and it is to be understood that various and numerous other arrangements may be devised by one skilled in the art without departing from the spirit and scope of the invention as limited only by the accompanying claims.

What is claimed is:

1. Connector apparatus for making contact with the electrical terminals of a printed wiring board comprising a plate (16) carrying a plurality of terminals (29) corresponding to the terminals of said board and mounted for lateral movement with respect to said board when the terminals of said board are correspondingly positioned opposite to said terminals (29) of said plate (16), and means for causing said lateral movement characterized in that said last-mentioned means comprises a shaft (37) rotatably mounted parallel to said plate (16), pin means (47) extending from one end of said plate (16), and a cam plate (40) fixedly mounted at one end of said shaft (37) substantially perpendicular thereto, said cam plate (40) having a slot (43) formed therein lying at an angle to a line on said cam plate (40) intersecting the longitudinal axes of said pin means (47) and said shaft (37) dimensioned to slidably receive said pin means (47), said angle being determined to cause a predetermined lateral movement of said plate (16) in one direction as said shaft (37) is rotated in one direction.

2. Connector apparatus for making contact with the electrical terminals of a printed wiring board comprising a pair of parallel plates (16, 17) mounted for lateral movement, at least one of said parallel plates (16, 17) carrying a plurality of terminals (29) corresponding to the terminals of said board, and means for causing said lateral movement characterized in that said last-mentioned means comprises a shaft (37) rotatably mounted parallel to said parallel shafts (16, 17), pin means (47, 48) extending from the same respective ends of said plates (16, 17), and a cam plate (40) fixedly mounted at one end of said shaft (37) substantially perpendicular thereto, said cam plate (40) having a pair of slots (43, 44) formed therein lying at opposing angles to a line on said cam plate intersecting the longitudinal axes of said pin means (47, 48) dimensioned to slidably receive said pin means (47, 48), said angles being determined to cause a predetermined lateral movement of said plates (16, 17) in opposite directions as said shaft (37) is rotated in one direction.

3. Connector apparatus for making contact with the electrical terminals of a plurality of printed wiring boards comprising a plate (16) carrying a plurality of terminals (29) corresponding to the terminals of said boards and mounted for lateral movement with respect to said boards when the terminals of said boards are correspondingly positioned opposite to said terminals (29) of said plate (16), and means for causing said lateral movement characterized in that said last-mentioned means comprises a shaft (37) rotatably mounted parallel to said plate (16)

pin means (47) extending from one end of said plate (16), and a cam plate (40) fixedly mounted at one end of said shaft (37) substantially perpendicular thereto, said cam plate (40) having a slot (43) formed therein lying at an angle to a line on said cam plate (40) intersecting the longitudinal axes of said pin means (47) and said shaft (37) dimensioned to slidably receive said pin means (47), said angle being determined to cause a predetermined lateral movement of said plate (16) in one direction as said shaft (37) is rotated in one direction.

4. Connector apparatus for making contact with the electrical terminals of a plurality of printed wiring boards comprising a pair of parallel plates (16, 17) mounted for lateral movement for making contact with the terminals of said boards when positioned therebetween, at least one of said parallel plates (16, 17) carrying a plurality of terminals (29) corresponding to the terminals of said boards, and means for causing said lateral movement characterized in that said last-mentioned means comprises a shaft (37) rotatably mounted parallel to said plates (16, 17), pin means (47, 48) extending from the same respective ends of said plates (16, 17), and a cam plate (40) fixedly mounted at one end of said shaft (37) substantially perpendicular thereto, said cam plate (40) having a pair of slots (43, 44) formed therein lying at opposing angles to a line on said cam plate intersecting the longitudinal axes of said pin means (47, 48) dimensioned to slidably receive said pin means (47, 48), said angles being determined to cause a predetermined lateral movement of said plates (16, 17) in opposite directions as said shaft (37) is rotated in one direction.

5. Connector apparatus for making contact with the electrial terminals of a first and a second printed wiring board comprising a first and a second plate (16, 18), each of said plates (16, 18) carrying a plurality of terminals (29) corresponding to the terminals of said first and second boards and mounted for lateral movement with respect to said first and second boards when the terminals of said first and second boards are correspondingly positioned opposite said terminals (29) of respective plates (16, 18), and means for causing said lateral movement characterized in that said last-mentioned means comprises a shaft (37) rotatably mounted parallel to said plates (16, 18), a first and a second pin means (47, 49) extending respectively from the corresponding ends of said first and second plates (16, 18), and a cam plate (40) fixedly mounted at one end of said shaft (37) substantially perpendicular thereto, said cam plate (40) having a first and a second slot (43, 45) formed therein dimensioned to slidably receive said pin means (47, 49), said first slot (43) lying at a first angle to a first line on said cam plate (40) intersecting the longitudinal axes of said first pin means (47) and said shaft (37), said second slot (45) lying at a second angle to a second line on said cam plate (40) intersecting the longitudinal axes of said second pin means (49) and said shaft (37), said first angle being determined to cause a first predetermined lateral movement of said first plate (16) in a first direction as said shaft (37) is rotated in one direction, said second angle being determined to cause a second predetermined lateral movement of said second plate (18) in a second direction as said shaft (37) is rotated in one direction.

6. Connector apparatus for making contact with the electrical terminals of a first and a second printed wiring board comprising a first and a second pair of parallel plates (16, 17; 18, 19), each of said pairs of plates (16, 17; 18, 19) being mounted for lateral movement, at least one of each of said pairs of plates (16, 17; 18, 19) carrying a plurality of terminals (29) corresponding to the terminals of respective boards, and means for causing said lateral movement characterized in that said last-mentioned means comprises a shaft (37) rotatably mounted parallel to said plates (16, 17; 18, 19), a first and a second pin means (47, 48; 49, 50) extending respectively from the corresponding ends of said first and said second pair of plates (16, 17; 18, 19), and a cam plate (40) fixedly mounted at one end of said shaft (37) substantially perpendicular thereto, said cam plate (40) having a first and a second pair of slots (43, 44; 45, 46) formed therein dimensioned to slidably receive said pin means (47, 48; 49, 50), said first pair of slots (43, 44) lying at a first pair of opposing angles to a first line on said cam plate (40) intersecting the longitudinal axes of said first pin means (47, 48), said second pair of slots (45, 46) lying at a second pair of opposing angles to a second line on said cam plate (40) intersecting the longitudinal axes of said second pin means (49, 50), said first pair of angles being determined to cause a first predetermined lateral movement of said first pair of plates (16, 17) in opposite directions as said shaft (37) is rotated in one direction, said second pair of angles being determined to cause a second predetermined lateral movement of said second pair of plates (18, 19) in opposite directions as said shaft (37) is rotated in one direction.

7. Connector apparatus for making contact with the electrical terminal of a first and a second plurality of printed wiring boards comprising a first and a second plate (16, 18), each of said plates (16, 18) carrying a plurality of terminals (29) corresponding to the terminals of said first and second plurality of boards and mounted for lateral movement with respect to said first and second plurality of boards when the terminals of said first and second plurality of boards are correspondingly positioned opposite said terminals (29) of respective plates (16, 18), and means for causing said lateral movement characterized in that last-mentioned means comprises a shaft (37) rotatably mounted parallel to said plates (16, 18), a first and a second pin means (47, 49) extending respectively from the correspondingly ends of said first and second plates (16, 18), and a cam plate (40) fixedly mounted at one end of said shaft (37) substantially perpendicular thereto, said cam plate (40) having a first and a second slot (43, 45) formed therein dimensioned to slidably receive said pin means (47, 49), said first slot (43) lying at a first angle to a first line on said cam plate (40) intersecting the longitudinal axes of said first pin means (47) and said shaft (37), said second slot (45) lying at a second angle to a second line on said cam plate (40) intersecting the longitudinal axes of said second pin means (49) and said shaft (37), said first angle being determined to cause a first predetermined lateral movement of said first plate (16) in a first direction as said shaft (37) is rotated in one direction, said second angle being determined to cause a second predetermined lateral movement of said second plate (18) in a second direction as said shaft (37) is rotated in one direction.

8. Connector apparatus for making contact with the electrical terminals of a first and a second plurality of printed wiring boards comprising a first and a second pair of plates (16, 17; 18, 19), each of said pairs of plates (16, 17; 18, 19) mounted for lateral movement, at least one of each of said pairs of plates (16, 17; 18, 19) carrying a plurality of terminals (29) corresponding to the terminals of respective boards, and means for causing said lateral movement characterized in that said last-mentioned means comprises a shaft (37) rotatably mounted parallel to said plates (16, 17; 18, 19), a first and a second pin means (47, 48; 49, 50) extending respectively from the corresponding ends of said first and said second pair of plates (16, 17; 18, 19), and a cam plate (40) fixedly mounted at one end of said shaft (37) substantially perpendicular thereto, said cam plate (40) having a first and a second pair of slots (43, 44; 45, 46) formed therein dimensioned to slidably receive said pin means (47 48; 49, 50), said first pair of slots (43, 44) lying at a first pair of opposing angles to a first line on said cam plate (40) intersecting the longitudinal axes of said first pin means (47, 48), said second pair of slots (45, 46) lying at a second pair of opposing angles to a second line on said cam plate (40) intersecting the longitudinal axes of said second pin means (49, 50), said first pair of angles being determined to cause a first predetermined lateral movement of said first pair of plates (16, 17) in opposite directions as said shaft (37) is rotated in one direction, said second pair of angles being determined to cause a second predetermined lateral movement of said second pair of plates (18, 19) in opposite directions as said shaft (37) is rotated in one direction.

9. Connector apparatus for making contact with the electrical terminals of a first and a second plurality of printed wiring boards comprising a first and a second pair of plates (16, 17; 18, 19), each of said pairs of plates (16, 17; 18, 19) being mounted for lateral movement, at least one of each of said pairs of plates (16, 17; 18, 19) carrying a plurality of terminals (29) corresponding to the terminals of respective boards, and means for causing said lateral movement characterized in that said last-mentioned means comprises a shaft (37) rotatably mounted parallel to said plates (16, 17; 18, 19), a first and a second pin means (47, 48; 49, 50) extending respectively from each of the opposite ends of said first and said second pair of plates (16, 17; 18, 19), and a pair of cam plates (39, 40) fixedly mounted at the opposite ends of said shaft (37) substantially perpendicular thereto, each of said cam plates (39, 40) having a first and a second pair of slots (43, 44; 45, 46) formed therein dimensioned to slidably receive said pin means (47, 48; 49, 50), said first pair of slots (43, 44) lying at a first pair of opposing angles to a first line on each of said cam plates (39, 40) intersecting the longitudinal axes of said first pin means (47, 48), said second pair of slots (45, 46) lying at a second pair of opposing angles to a second line on each of said cam plates (39, 40) intersecting the longitudinal axes of said second pin means (49, 50), said first pair of angles being determined to cause a first predetermined lateral movement of said first pair of plates (16, 17) in opposite directions as said shaft (37) is rotated in one direction, said second pair of angles being determined to cause a second predetermined lateral movement of said second pair of plates (18, 19) in opposite directions as said shaft (37) is rotated in one direction.

10. Apparatus for supporting an electrical printed wiring board comprising a pair of parallel plates (16, 17), pin means (47) extending from one end of one of said plates (16, 17), and a cam plate (40) arranged substantially at right angles to said plates (16, 17) and rotatable about an axis therein, said plate (40) having a slot (43) dimensioned to slidably receive said pin means (47), said slot (43) lying at a predetermined angle with a line between said axis and the axis of said pin means (47) to cause said one plate (16) to move toward and away from the other plate (17) as said cam plate (40) is rotated in one and the opposite direction.

11. Apparatus for supporting an electrical wiring board comprising a pair of parallel plates (16, 17), and a mechanism for closing said plates (16, 17) upon a wiring board comprising a cam plate (40) arranged substantially at right angles to one end of said plates (16, 17) and rotatable about an axis in said cam plate (40), said cam plate (40) having a pair of slots (43, 44), and a pin means (47, 48) extending from each of said plates (16, 17) at said one end slidably fitted respectively in said slots (43, 44), said slots (43, 44) lying at predetermined angles with a line intersecting the longitudinal axes of said pin means (47, 48) to cause said plates (16, 17) to move toward and away from each other as said cam plate (40) is rotated in one and the opposite direction.

* * * * *